US006055670A

United States Patent [19]

Parker

[11] Patent Number: 6,055,670

[45] Date of Patent: May 2, 2000

[54] BREATH-HEATED INSULATED GLOVE AND ASSOCIATED METHOD

[76] Inventor: Kirk A. Parker, 8929 Waterton Pl., Fishers, Ind. 46038

[21] Appl. No.: 09/290,978

[22] Filed: Apr. 13, 1999

[51] Int. Cl.[7] ..... A41D 19/00

[52] U.S. Cl. ..... 2/161.1; 2/16; 2/161.6; 2/163

[58] Field of Search ..... 2/159, 16, 20, 2/160, 161.5, 161.6, 162, 163, 164, DIG. 3

[56] References Cited

U.S. PATENT DOCUMENTS

| | | | |
|---|---|---|---|
| 2,842,771 | 7/1958 | Foti | 2/159 |
| 2,966,684 | 1/1961 | Bonin | 2/81 |
| 3,755,820 | 9/1973 | Petrusek | 2/18 |
| 3,874,000 | 4/1975 | Altman | 2/158 |
| 4,087,675 | 5/1978 | Sansonetti | 219/211 |
| 4,965,886 | 10/1990 | Ockels | 2/2.1 |
| 5,025,502 | 6/1991 | Raymond et al. | 2/159 |
| 5,120,304 | 6/1992 | Sasaki | 604/35 |
| 5,309,573 | 5/1994 | Solar et al. | 2/160 |
| 5,369,807 | 12/1994 | Cho et al. | 2/159 |

FOREIGN PATENT DOCUMENTS

| | | | |
|---|---|---|---|
| 1508-188 | 4/1978 | United Kingdom | A41D 19/00 |

*Primary Examiner*—John J. Calvert
*Assistant Examiner*—Katherine Moran
*Attorney, Agent, or Firm*—Maginot, Addison & Moore

[57] ABSTRACT

An insulted glove includes a bladder having an air chamber defined therein. The insulated glove also includes an inlet valve which is in fluid communication with the air chamber. The insulted glove further includes an outlet valve which is in fluid communication with the air chamber. The air chamber of the bladder has a number of baffles positioned therein so as to direct a flow of air from the inlet valve to the outlet valve. The insulated glove also includes an inner lining and an outer liner with the bladder being positioned therebetween. Moreover, the insulated glove includes an insulation layer disposed between the bladder and the outer lining. A method for warming a hand of a user is also disclosed.

19 Claims, 3 Drawing Sheets

BREATH-HEATED INSULATED GLOVE AND ASSOCIATED METHOD

TECHNICAL FIELD OF THE INVENTION

The present invention relates generally to an insulated glove, and more particularly to a breath-heated insulated glove and associated method.

BACKGROUND OF THE INVENTION

Insulated gloves are commonly worn in order to keep one's hands warm during exposure to cold temperatures. Insulated gloves are particularly useful to a sportsman such as a hunter since he or she often spends extended periods of time positioned in a blind or perched in a tree stand while exposed to the cold temperatures associated with a particular hunting season.

Insulated gloves which have heretofore been designed are typically constructed out of a number of layers of natural and/or synthetic fibers which insulate the user's hands from cold temperatures. Moreover, these insulated gloves may also be constructed of fibers which render the glove water resistant so as to prevent the user's hands from becoming wet if the glove comes into contact with water or other types of liquid.

In a further effort to provide insulated gloves with enhanced heating characteristics, a number of insulated gloves have heretofore been designed which include a heating mechanism for generating heat which is transferred to the user's hands. For example, some of these insulated gloves include an electric heating mechanism which is powered by a small battery such as a common nine-volt (9V) battery. Hence, such heated gloves improve on the above-described insulated gloves by providing enhanced warming capabilities since they generate additional heat which compliments the user's body heat in order to keep the user's hands warm.

However, such prior art heated gloves have a number of drawbacks associated therewith. For example, such heated gloves are relatively expensive. In particular, use of an electric heating mechanism undesirably increases costs associated with manufacture of the heated glove. Moreover, each heated glove must also be equipped with a separate battery. Hence, over the useful life of the heated gloves, the user must install a relatively large number of batteries into the gloves thereby undesirably increasing costs associated with operation of the gloves. Moreover, heated gloves which utilize an electric heating mechanism are particularly susceptible to failure. In particular, it is known that the electric heating mechanism associated with these heated gloves commonly fail or otherwise cease to operate if the heated gloves are immersed or otherwise exposed to water thereby reducing the useful life of the heated gloves. Such a susceptibility to failure is particular disadvantageous to sportsmen such as hunters since many of their activities are performed near bodies of water such as lakes and streams.

What is needed therefore is a heated insulated glove which overcomes one or more of the above-mentioned drawbacks. What is particularly needed is a heated insulated glove which is relatively inexpensive to manufacture and utilizes a relatively small number of components. What is also needed is a heated insulated glove which has a relatively long useful life. What is further needed is a heated insulated glove which does not require a battery or other stored energy source during use thereof.

SUMMARY OF THE INVENTION

In accordance with a first embodiment of the present invention, there is provided an insulated glove. The insulted glove includes a bladder having an air chamber defined therein. The insulated glove also includes an inlet valve which is in fluid communication with the air chamber. The insulted glove further includes an outlet valve which is in fluid communication with the air chamber. The air chamber of the bladder has a number of baffles positioned therein so as to direct a flow of air from the inlet valve to the outlet valve.

In accordance with a second embodiment of the present invention, there is provided a method of warming a hand of a user with a glove in which the hand of the user is located. The glove has an inlet valve and an outlet valve. The method includes the step of blowing air into the inlet valve from a mouth of the user. Moreover, the method includes the step of exhausting air from the outlet valve in response to the blowing step.

In accordance with a third embodiment of the present invention, there is provided a warming apparatus for warming a body part of a user. The warming apparatus includes a body part compartment for receiving the body part of the user. The warming apparatus also includes a bladder having an air chamber defined therein. Moreover, the warming apparatus includes an inlet valve which is in fluid communication with the air chamber. Yet further, the warming apparatus includes an outlet valve which is in fluid communication with the air chamber. The air chamber of the bladder has a number of baffles positioned therein so as to direct a flow of air from the inlet valve to the outlet valve. Heat from air within the air chamber is transferred to the body part when the body part is located in the body part compartment.

It is therefore an object of the present invention to provide a new and useful heated insulated glove.

It is moreover an object of the present invention to provide an improved heated insulated glove.

It is therefore an object of the present invention to provide a new and useful method of warming a hand of a user.

It is moreover an object of the present invention to provide an improved method of warming a hand of a user.

It is yet further an object of the present invention to provide a heated insulated glove which is relatively inexpensive to manufacture and utilizes a relatively small number of components.

It is yet another object of the invention to provide a heated insulated glove which has a relatively long useful life.

In addition, it is yet another object of the present invention to provide a heated insulated glove which does not require a battery or other stored energy source during use thereof.

The above and other objects, features, and advantages of the present invention will become apparent from the following description and the attached drawings.

DETAILED DESCRIPTION OF THE INVENTION

Figure 1:
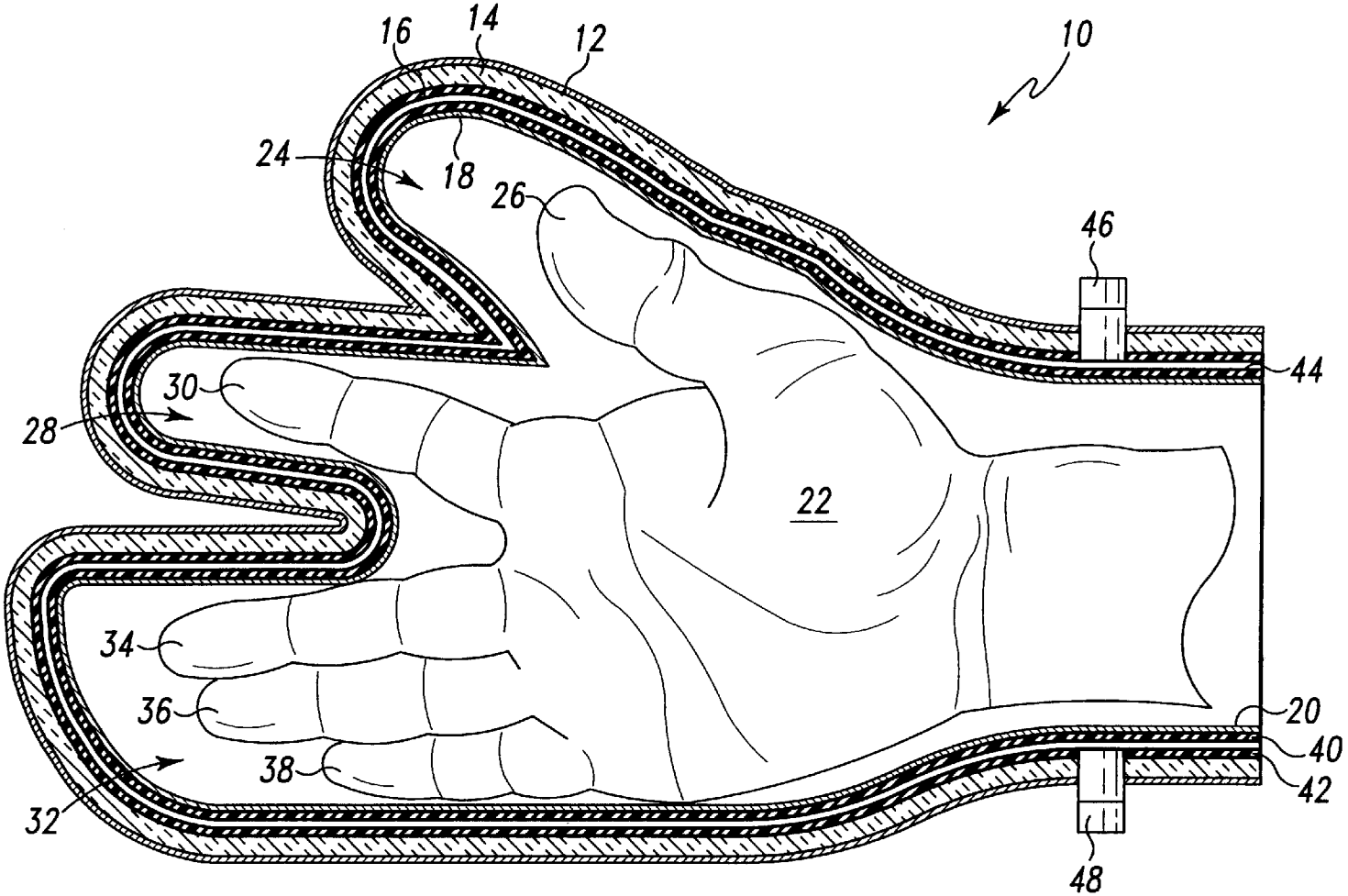
FIG. 1 is a cross sectional view of a heated insulated glove which incorporates the features of the present invention therein, note that (1) the cross sectional view of FIG. 1 is taken along the line 1—1 of FIG. 3 (as viewed in the direction of the arrows), and (2) the inlet valve and the outlet valve are not shown in cross section for clarity of description.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
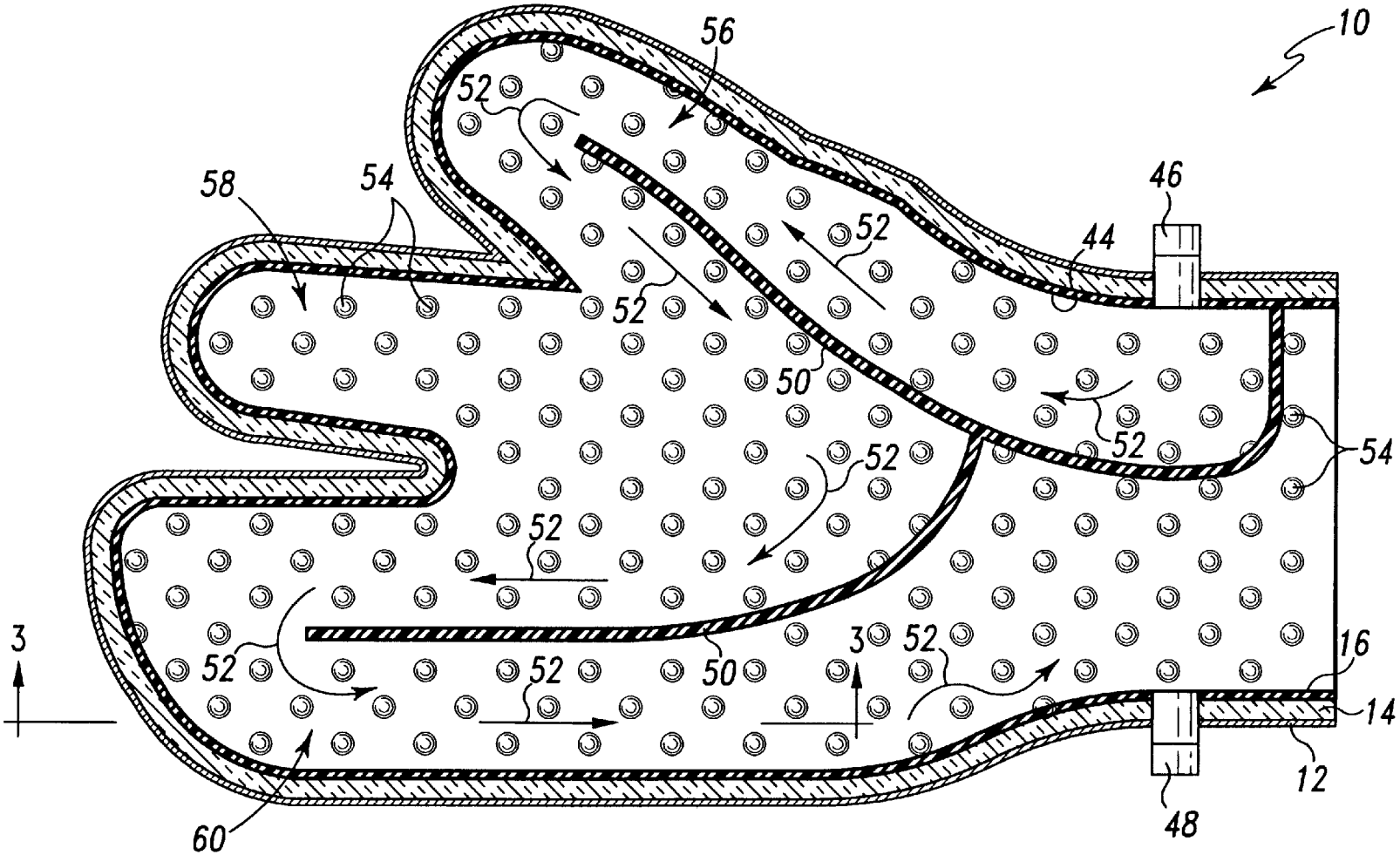
FIG. 2 is a cross sectional view similar to FIG. 1, but taken along the line 2—2 of FIG. 3 (as viewed in the direction of the arrows)
Figure 3:
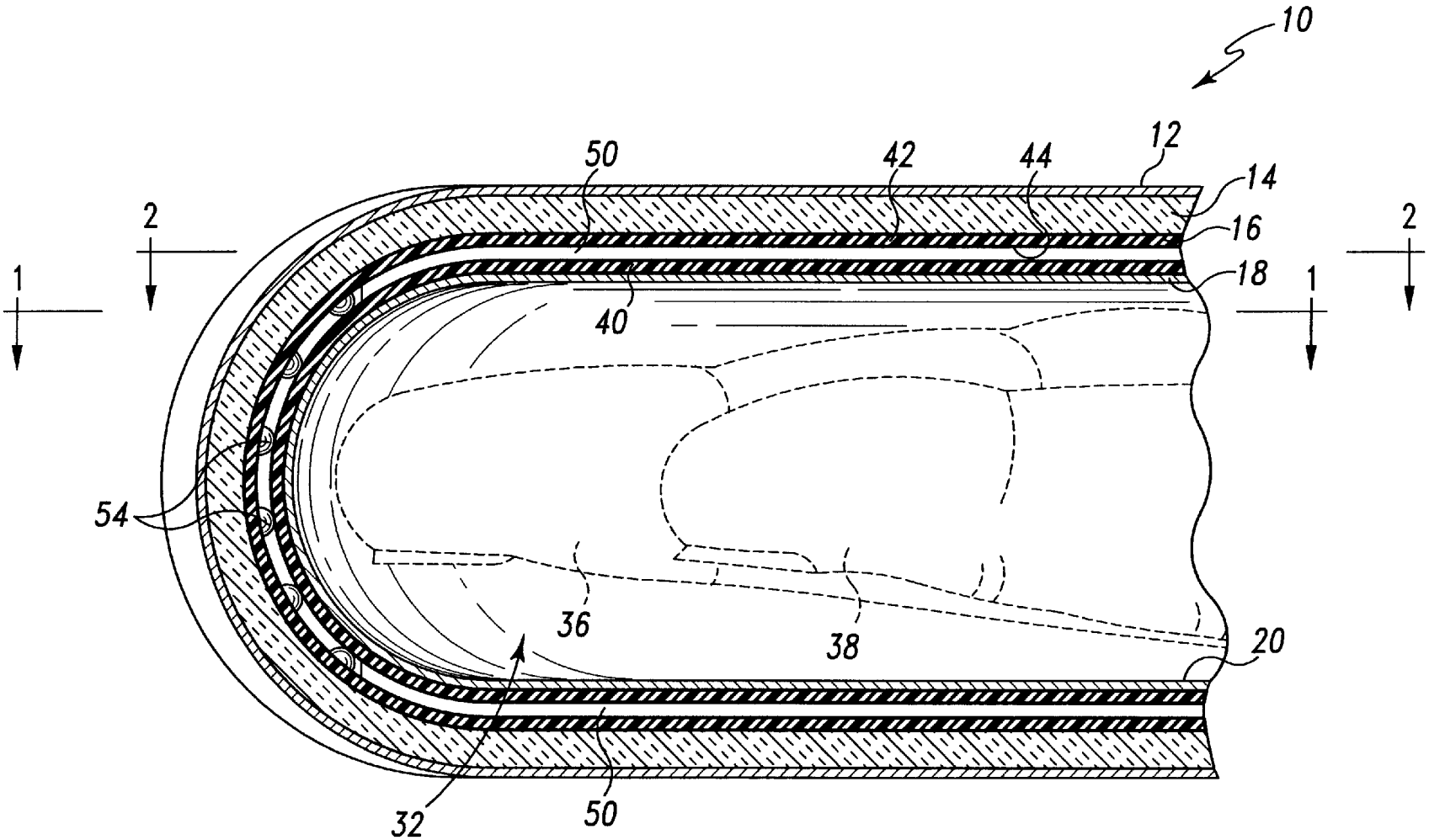
FIG. 3 is an enlarged partial cross-sectional view taken along the line 3—3 of FIG. 2 (as viewed in the direction of the arrows).

Referring now to FIGS. 1–3, there is shown an heated insulated glove 10. The heated insulated glove 10 includes an outer lining 12, an insulation layer 14, a bladder 16, and an inner liner 18. The outer lining 12 and the inner lining 18 are preferably constructed of a thin, light weight, resilient material such as nylon. The insulation layer 14 is preferably constructed of a thin, light weight, synthetic insulation material which has desirable insulating characteristics. One such synthetic insulation material which may be utilized as the insulation layer 14 of the present invention is sold under the trade name "Polartec" and is commercially available from Maiden Mills, Incorporated of Lawrence, Massachusetts. Another synthetic insulation material which may be utilized as the insulation layer 14 of the present invention is sold under the trade name "Thinsulate" and is commercially available from 3M Corporation of St. Paul, Minn. Moreover, the bladder is constructed of a flexible material which is impervious to air such as rubber.

As shown in FIGS. 1 and 3, the heated insulated glove 10 has a hand compartment 20 defined therein for receiving a hand 22 of a user. As shown in FIG. 1, the hand compartment 20 is preferably divided into a first compartment portion 24 for receiving the user's thumb 26, a second compartment portion 28 for receiving the user's index finger 30, and a third compartment portion 32 for receiving the user's remaining fingers 34, 36, 38. It should be appreciated that such a finger arrangement provides the heated insulated glove 10 of the present invention with numerous advantages over insulated gloves which have heretofore been designed. For example, the finger arrangement of the insulated heated glove 10 provides for the low-heat loss characteristics of a mitten, yet also provides for freedom of movement of the index finger 30. It should be appreciated that such freedom of movement of the index finger 30 is particularly useful for sportsmen such as hunters since the index finger 30 is commonly utilized to operate mechanisms such as the trigger of a hunting rifle or shotgun.

The bladder 16 is positioned so as to allow for the transfer of heat from air within the bladder 16 to the user's hand 22 located in the hand compartment 20. In particular, the bladder 16 includes an inner wall 40 and an outer wall 42 thereby defining an air chamber 44 therebetween. An air inlet valve 46 and an air outlet valve 48 are secured to the bladder 16. Both the air inlet valve 46 and the air outlet valve 48 are in fluid communication with the air chamber 44. In particular, the air inlet valve 46 is preferably configured as a one-way check valve which allows a user to blow air into the air chamber 44, but prevents air from backflowing or otherwise exiting the air chamber 44 therethrough. Moreover, the air outlet valve 48 is preferably configured as a pressure release valve which opens when air pressure within the air chamber 44 increases above a predetermined pressure limit as a result of a user blowing air into the air chamber 44 via the air inlet valve 46. However, the pressure release outlet valve 48 remains closed so as to prevent air from exiting or otherwise being exhausted from the air chamber 44 when the user is not blowing air into the air inlet valve 46.

As shown in FIG. 2, a number of baffles 50 are positioned in the air chamber 44. As indicated by the arrows 52, the baffles 50 are provided to direct a flow of air from the air inlet valve 46 to the air outlet valve 48. In particular, when the user blows air into the air inlet valve 46, the resultant flow of air is impinged off of the inner wall 40 and the outer wall 42 of the bladder 16 along with the baffles 50 so as to be directed from the air inlet valve 46 to the air outlet valve 48. It should be appreciated that the configuration of the baffles 50 shown in FIG. 2 is exemplary in nature, and that one of ordinary skill in the art may modify the configuration of the baffles 50 so as to create a desired flow path in order to meet the needs of a given glove design.

The inner wall 40 and the outer wall 44 of the bladder 16 have a number of protrusions 54 extending therefrom. The protrusions 54 are preferably integrally molded with the walls 40, 42 of the bladder 16 and are provided to prevent the bladder 16 from collapsing when the air chamber 44 is devoid of air.

Heat from air within the air chamber 44 of the bladder 16 is transferred to the user's hand 22 positioned in the hand compartment 20 of the heated insulated glove 10. In particular, as shown in FIG. 2, the bladder 16 includes a first bladder portion 56 which corresponds with the first compartment portion 24 of the hand compartment 20 thereby allowing heat from air within in the air chamber 44 to be transferred to the user's thumb 26 when it is located in the first compartment portion 24. Similarly, the bladder 16 includes a second bladder portion 58 which corresponds with the second compartment portion 28 of the hand compartment 20 thereby allowing heat from air within in the air chamber 44 to be transferred to the user's index finger 30 when it is located in the second compartment portion 28. Moreover, the bladder 16 includes a third bladder portion 60 which corresponds with the third compartment portion 32 of the hand compartment 20 thereby allowing heat from air within in the air chamber 44 to be transferred to the user's remaining fingers 34, 36, 38 when they are located in the third compartment portion 32.

In operation, the user initially places his or her hand in the hand compartment 20 of the heated insulated glove 10 such that the user's thumb 26 is positioned in the first compartment portion 24, the user's index finger 30 is positioned in the second compartment portion 28, and the user's remaining fingers 34, 36, 38 are positioned in the third compartment portion 32. The user may then place his or mouth on the air inlet valve 46 and thereafter blow air into the air inlet valve 46. The warm air from the user's mouth then fills the air chamber 44 of the bladder 16. Heat from the warm air in the air chamber 44 is then transferred to the user's hand 22 via a thermal path which includes the inner wall 40 of the bladder 16 and the inner lining 18. Moreover, the air filled bladder 16 also functions as an additional insulation layer which insulates the user's hand 22 from cold temperatures.

After a period of time, the air within the air chamber 44 cools due to heat loss. In order to replace the cooled air within the air chamber 44 with warm air, the user simply blows on the air inlet valve 46 so as to create a flow of heated air. The flow of heated air is directed through the air chamber 44 by the walls 40, 42 of the bladder 16 and the baffles 50 in order to be advanced toward the air outlet valve 48. Such an introduction of heated air by the user blowing into the air inlet valve 46 causes an increase in air pressure in the air chamber 44 thereby causing the pressure release air outlet valve 48 to open thereby exhausting or otherwise forcing cooled or spent air out of the air outlet valve 48. When the user ceases to blow air into the air inlet valve 46, air pressure within the air chamber 44 drops thereby causing the pressure release air outlet valve 48 to close. Such closure of the pressure release air outlet valve 48 causes a portion of the warm air (i.e. the air that was blown into the air inlet valve 46 by the user) to be trapped or otherwise contained in the air chamber 44 of the bladder 16. Thereafter, heat from the contained warm air is transferred to the user's hands 22 in the manner described above. It should be appreciated that the air within air chamber 44 may be replenished in the above-described manner as often as needed in order to keep the user's hands at a desired temperature.

Hence, as described herein, the heated insulated glove 10 of the present invention has numerous advantages over heated insulated gloves which have heretofore been designed. For example, the heated insulated glove 10 of the present invention is relatively inexpensive to manufacture and utilizes a relatively small number of components. Moreover, the construction and configuration of the heated insulated glove 10 of the present invention provides a heated insulated glove which has a relatively long useful life. Moreover, the heated insulated glove 10 of the present invention generates heat without use of a battery or other stored energy source during use thereof thereby reducing costs associated with use of the heated insulated glove 10.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

For example, although a specific embodiment of the arrangement of the linings 12, 18 and the insulation layer 14 has been described herein, and has significant advantages thereby in the present invention, certain of such advantages may be achieved by use of other arrangements. For instance, a second insulation layer similar to the insulation layer 14 may be provided between the bladder 16 and the inner lining 18. Moreover, the inner lining 18 may be removed altogether with the inner wall 40 of the bladder 16 functioning as an inner lining. Such a configuration places the bladder 16 in direct contact with the user's hand 22 thereby creating an efficient thermal path for transferring heat from the air within the air chamber 44 to the user's hand 22.

Moreover, although a specific embodiment of the finger arrangement of the heated insulated glove 10 in which the user's index finger 30 is received into a dedicated hand compartment portion (e.g. the hand compartment portion 28), other finger arrangements may also be utilized in conjunction with the concepts of the present invention. For example, a traditional mitten arrangement may be utilized in which each of the user's fingers 30, 34, 36, 38 except for his or her thumb 26 is received into a single hand compartment portion. Similarly, a traditional glove arrangement may also be utilized in which each of the user's fingers 26, 30, 34, 36, 38 is received into a separate hand compartment portion. It should be appreciated that the configuration of the baffles 50 may be altered to fit the needs of any alternative finger arrangement of the heated insulated glove 10.

Yet further, although the heated insulated glove 10 of the present invention is described herein as being utilized to warm a user's hands 22, has significant advantages thereby in the present invention, it should be appreciated that the concepts of the present invention may be utilized to warm other body parts. For example, the concepts of the present invention may be utilized in the construction of heated socks which are utilized to warm a user's feet. In such a configuration, the inlet valve 46 may be configured with a relatively long plastic tube attached thereto so as to facilitate the process of blowing warm air into the air chamber 44 of the bladder 16 by the user. Moreover, the concepts of the present invention may also be utilized in devices which are designed to warm other body parts, or even the entire body. For example, the concepts of the present invention may be utilized in the construction of a heated vest or sleeping bag.

There are a plurality of advantages of the present invention arising from the various features of the heated insulated glove described herein. It will be noted that alternative embodiments of the heated insulated glove of the present invention may not include all of the features described yet still benefit from at least some of the advantages of such features. Those of ordinary skill in the art may readily devise their own implementations of the heated insulated glove that incorporate one or more of the features of the present invention and fall within the spirit and scope of the present invention as defined by the appended claims.

What is claimed is:

1. An insulated glove, comprising:

a bladder having an air chamber defined therein;

an inlet valve which is in fluid communication with said air chamber;

an outlet valve which is in fluid communication with said air chamber; and a hand compartment for receiving a hand of a user, wherein said air chamber of said bladder has a number of baffles positioned therein so as to direct a flow of air from said inlet valve to said outlet valve, and wherein said bladder is positioned so as to transfer heat from air within said air chamber to said hand of said user when (i) said hand of said user is positioned in said hand compartment, and (ii) said air chamber has air present therein.

2. The insulated glove of claim 1, further comprising (i) an inner lining, and (ii) and outer lining, wherein said bladder is interposed between said inner lining and said outer lining.

3. The insulated glove of claim 2, further comprising an insulation layer, wherein said insulation layer is interposed between said bladder and said outer lining.

4. The insulated glove of claim 1, wherein:

said inlet valve includes a check valve, said check valve is configured to allow air to enter said bladder therethrough when a user of said insulated glove blows air into said check valve, and said check valve is further configured to prevent air from exiting said bladder therethrough.

5. The insulated glove of claim 1, wherein:

said outlet valve includes a pressure release valve, said pressure release valve is configured to allow air to exit said bladder therethrough when a user of said insulated glove blows air into said inlet valve, and said pressure release valve is further configured to prevent air from exiting said bladder therethrough when said user ceases to blow air into said inlet valve.

6. The insulated glove of claim 1, wherein:

said hand compartment includes (i) a thumb compartment for receiving a thumb of said user, and (ii) an index finger compartment for receiving an index finger of said user, said number of baffles are configured so as to direct air to a thumb portion of said bladder, said thumb portion of said bladder being positioned so as to transfer heat from air within said air chamber to said thumb of said user when (i) said thumb of said user is positioned in said thumb compartment, and (ii) said air chamber has air present therein, and said number of baffles are configured so as to direct air to a index finger portion of said bladder, said index finger portion of said bladder being positioned so as to transfer heat from air within said air chamber to said index finger of said user when (i) said index finger of said user is positioned in said index finger compartment, and (ii) said air chamber has air present therein.

7. The insulated glove of claim 1, wherein:

said bladder includes a bladder wall having a number of protrusions secured thereto, and said protrusions are configured to protrude into said air chamber so as to prevent said bladder from collapsing when said air chamber is devoid of air.

8. A method of warming a hand of a user with a glove in which said hand of said user is located, said glove having an inlet valve and an outlet valve, comprising the steps of:

blowing air into said inlet valve from a mouth of said user; and exhausting air from said outlet valve in response to said blowing step.

9. The method of claim 8, wherein said glove further has a bladder which is in fluid communication with both said inlet valve and said outlet valve, further comprising the steps of:

advancing air into said bladder in response to said blowing step; and trapping air in said bladder at a location between said inlet valve and said outlet valve.

10. The method of claim 9, further comprising the step of transferring heat from air contained within said bladder to said hand of said user.

11. The method of claim 9, wherein:

said inlet valve includes a check valve, said blowing step includes the step of advancing air into said bladder through said check valve, and said containing step includes the step of preventing air from exiting said bladder through said check valve.

12. The method of claim 9, wherein:

said outlet valve includes a pressure release valve, said exhausting step includes the step of advancing air out of said bladder through said pressure release valve, and said containing step includes the step of preventing air from exiting said bladder through said pressure release valve.

13. A warming apparatus for warming a body part of a user, comprising:

a body part compartment for receiving said body part of said user;

a bladder having an air chamber defined therein;

an inlet valve which is in fluid communication with said air chamber;

an outlet valve which is in fluid communication with said air chamber, wherein (i) said air chamber of said bladder has a number of baffles positioned therein so as to direct a flow of air from said inlet valve to said outlet valve, and (ii) heat from air within said air chamber is transferred to said body part when said body part is located in said body part compartment.

14. The warming apparatus of claim 13, further comprising (i) an inner lining, and (ii) and outer lining, wherein said bladder is interposed between said inner lining and said outer lining.

15. The warming apparatus of claim 14, further comprising an insulation layer, wherein said insulation layer is interposed between said bladder and said outer lining.

16. The warming apparatus of claim 13, wherein:

said inlet valve includes a check valve, said check valve is configured to allow air to enter said bladder therethrough when a user of said warming apparatus blows air into said check valve, and said check valve is further configured to prevent air from exiting said bladder therethrough.

17. The warming apparatus of claim 13, wherein:

said outlet valve includes a pressure release valve, said pressure release valve is configured to allow air to exit said bladder therethrough when a user of said warming apparatus blows air into said inlet valve, and said pressure release valve is further configured to prevent air from exiting said bladder therethrough when said user ceases to blow air into said inlet valve.

18. The warming apparatus of claim 13, wherein:

said body part includes a hand of said user, said body part compartment is configured to receive said hand of said user, and heat from air within said air chamber is transferred to said hand of said user when said hand of said user is located in said body part compartment.

19. The warming apparatus of claim 13, wherein:

said body part includes a foot of said user, and said body part compartment is configured to receive said foot of said user, and heat from air within said air chamber is transferred to said foot of said user when said user is located in said body part compartment.

* * * * *